US007934289B2

(12) United States Patent
Kwon

(10) Patent No.: US 7,934,289 B2
(45) Date of Patent: May 3, 2011

(54) FOLDABLE CROSS-PATTERNED PULL-HANDLE AND BAG HAVING THE SAME

(75) Inventor: Hyung Joo Kwon, Gyeonggi-do (KR)

(73) Assignee: Carimax Corporation, Gwangju-si, Gyeonggi-do (KR)

( * ) Notice: Subject to any disclaimer, the term of this patent is extended or adjusted under 35 U.S.C. 154(b) by 360 days.

(21) Appl. No.: 12/142,513

(22) Filed: Jun. 19, 2008

(65) Prior Publication Data

US 2009/0242342 A1 Oct. 1, 2009

(30) Foreign Application Priority Data

Apr. 1, 2008 (KR) ..... 10-2008-0030244

(51) Int. Cl.
*B25G 1/04* (2006.01)

(52) U.S. Cl. ..... 16/113.1; 16/405; 16/429

(58) Field of Classification Search ..... 16/113.1, 16/405, 429, 436; 15/143.1, 144.1, 144.2, 15/144.4, 144.3; 294/15, 16, 57; 190/105, 190/18 A See application file for complete search history.

(56) References Cited

U.S. PATENT DOCUMENTS

| | | | | | |
|---|---|---|---|---|---|
| 1,628,563 | A | * | 5/1927 | Taylor | 294/119 |
| 3,112,135 | A | * | 11/1963 | Salomonson | 294/119 |
| 4,109,952 | A | * | 8/1978 | Monzain | 294/16 |

FOREIGN PATENT DOCUMENTS

| | | | | |
|---|---|---|---|---|
| CN | 1201632 | A | | 12/1998 |
| DE | 2653316 | A | * | 6/1978 |
| FR | 2272574 | A | * | 1/1976 |
| GB | 2111917 | A | * | 7/1983 |
| KR | 0322564 | | | 8/2003 |

* cited by examiner

*Primary Examiner* — Chuck Y. Mah

(74) *Attorney, Agent, or Firm* — Weingarten, Schurgin, Gagnebin & Lebovici LLP

(57) ABSTRACT

Disclosed is a foldable cross-patterned pull-handle and a bag having the same. The pull-handle includes a folding means having a first link assembly and a second link assembly connected to an end of the first link assembly so that the folding means can be folded and retracted or unfolded and extended, the first link assembly having two links connected to each other so that the links cross each other at a center portion, a first end of the second link assembly being supported on a bag; and a handle means mounted on a second end of the folding means and grabbed by a user with hand. Due to the structural characteristics of the link assemblies constituting the folding means, the length of the bag handle can be adjusted variously by folding or unfolding it, and the bag handle can be installed in a reduced space.

20 Claims, 16 Drawing Sheets

FOLDABLE CROSS-PATTERNED PULL-HANDLE AND BAG HAVING THE SAME

This application claims priority to Republic of Korea Appln. No. 10-2008-0030244 filed Apr. 1, 2008.

BACKGROUND OF THE INVENTION

1. Field of the Invention

The present invention relates to a foldable cross-patterned pull-handle and a bag having the same. More particularly, the present invention relates to a foldable cross-patterned pull-handle having a folding means adapted to be folded or unfolded so that the pull-handle can be installed in a reduced installation space while ensuring that the length can be variously modified, as well as a bag having the same.

2. Description of the Prior Art

As generally known in the art, bags are used to contain documents, clothes, or other types of items and carry them conveniently. Bags come in various sizes and shapes according to the purpose of use or the type of items to be contained.

Among bags, suitcases are used during long trips to contain a number of items in a compact manner and carry them conveniently.

A conventional suitcase 1, as shown in FIG. 1, has a number of wheels 2 on the lower portion so that it can be transported conveniently, and a handle means 3 mounted on a lateral surface.

The handle means 3 is mounted on a lateral surface of the interior of the bag 1 so that it can be retracted/extended. A support means 4 is positioned inside the bag 1 and is provided with a storage space so that the handle means 3 can retract into the space. The handle means 3 has a number of tubes 3*a* connected to each other so that it can extend/retract and can remain fixed by the support means 4 in a stepwise manner.

When the bag 1 is to be moved, the handle means 3 is extended upward near the waist of the user, and is grabbed by hand to slant the bag 1 relative to the ground. Then, the bag 1 is moved while the wheels 2 roll.

However, the handle means 3 mounted on the bag 1 according to the prior art has a problem in that, as shown in FIG. 1, the support means 4, which extends from the bottom of a lateral surface of the interior of the bag 1 to the top, occupies a large installation space, which can otherwise be used to contain more items.

Furthermore, the length of the handle means 3 is conventionally adjusted in two or three steps, and there are limitations in extending the handle means 3 in conformity with varying physical sizes of users.

SUMMARY OF THE INVENTION

Accordingly, the present invention has been made to solve the above-mentioned problems occurring in the prior art, and the present invention provides a foldable cross-patterned pull-handle having a handle means installed in a reduced space, as well as a bag having the same.

The present invention also provides a foldable cross-patterned pull-handle having a handle means adapted to be extended up to various lengths to improve user convenience, as well as a bag having the same.

In accordance with an aspect of the present invention, there is provided a foldable cross-patterned pull-handle including a folding means having a plurality of link assemblies so that the folding means can be folded and retracted or unfolded and extended, each link assembly having two links connected to each other so that the links cross each other at a center portion, one end of the folding means being supported on a bag; and a handle means mounted on a second end of the folding means and grabbed by a user with hand.

The handle means includes a handle housing grabbed by the user with hand, a sliding hole extending through a side of the handle housing; and a pair of fixing bars mounted on both ends of the sliding hole so as to slide along the sliding hole, the second end of the folding means being rotatably connected to each fixing bar.

The handle means further includes a fixing means interposed between middle portions of the fixing bars to temporarily suspend a movement of the fixing bars so that the folding means can temporarily remain still after having been extended by a desired length.

BRIEF DESCRIPTION OF THE DRAWINGS

The above and other objects, features, and advantages of the present invention will be more apparent from the following detailed description taken in conjunction with the accompanying drawings, in which.

DETAILED DESCRIPTION OF THE EXEMPLARY EMBODIMENTS

Figure 1:
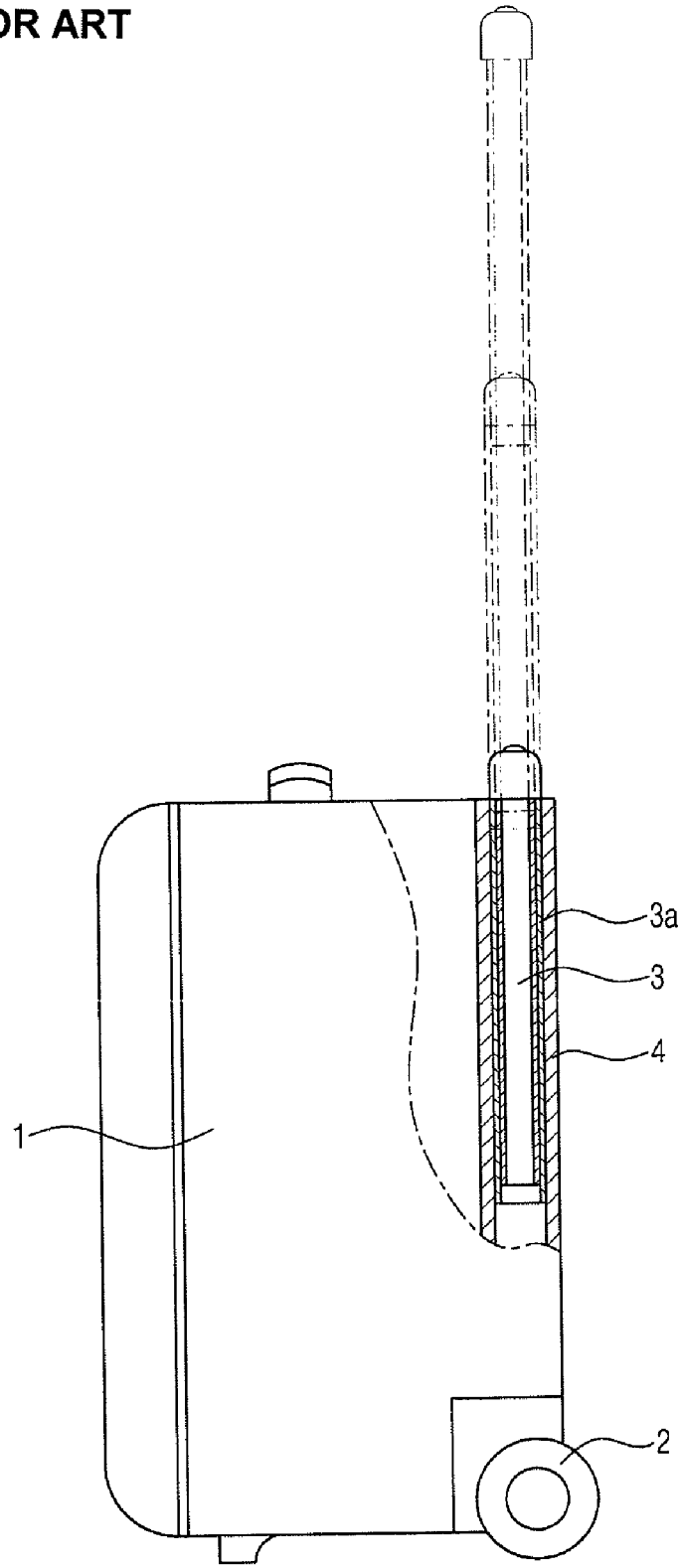
Fig. 1 PRIOR ART
FIG. 1 is a sectional view of a conventional pull-handle.

Hereinafter, a foldable cross-patterned pull-handle and a bag having the same according to an exemplary embodiment of the present invention will be described with reference to the accompanying drawings. In the following description and drawings, the same reference numerals are used to designate the same or similar components, and so repetition of the description on the same or similar components will be omitted.

Figure 2:
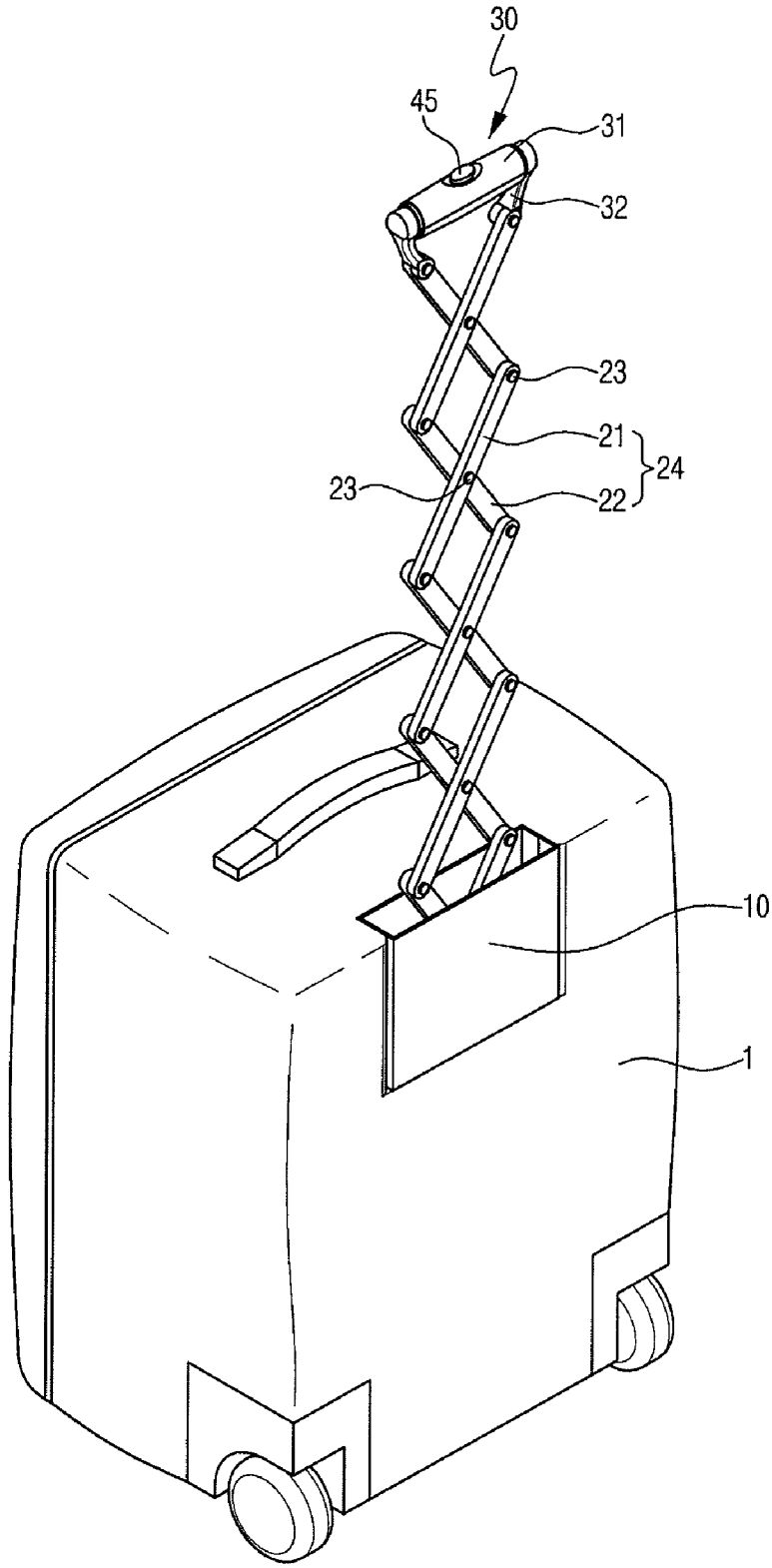
FIG. 2 is a perspective view of a foldable cross-patterned pull-handle according to a first exemplary embodiment of the present invention.
Figure 3:
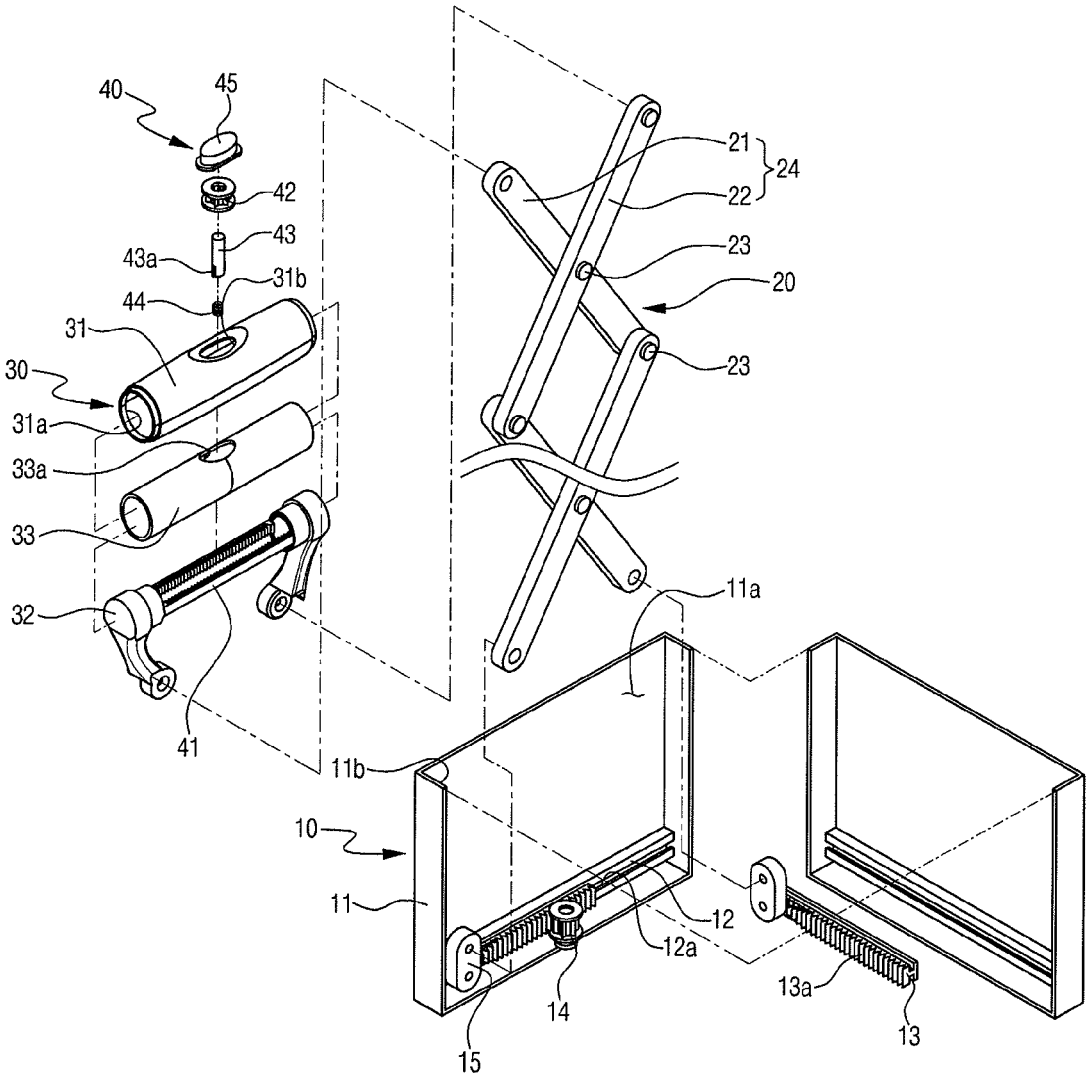
FIG. 3 is an exploded perspective view of the foldable pull-handle.
Figure 4:
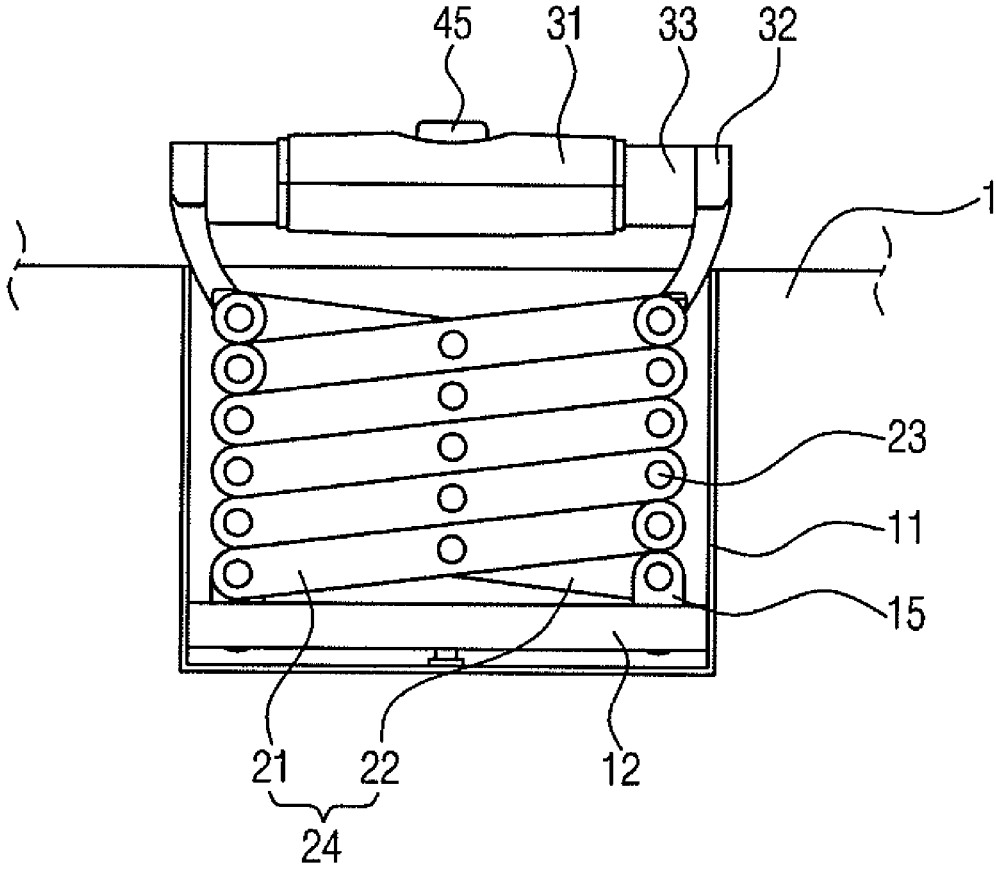
FIG. 4 shows a folding means when folded and retracted.
Figure 5:
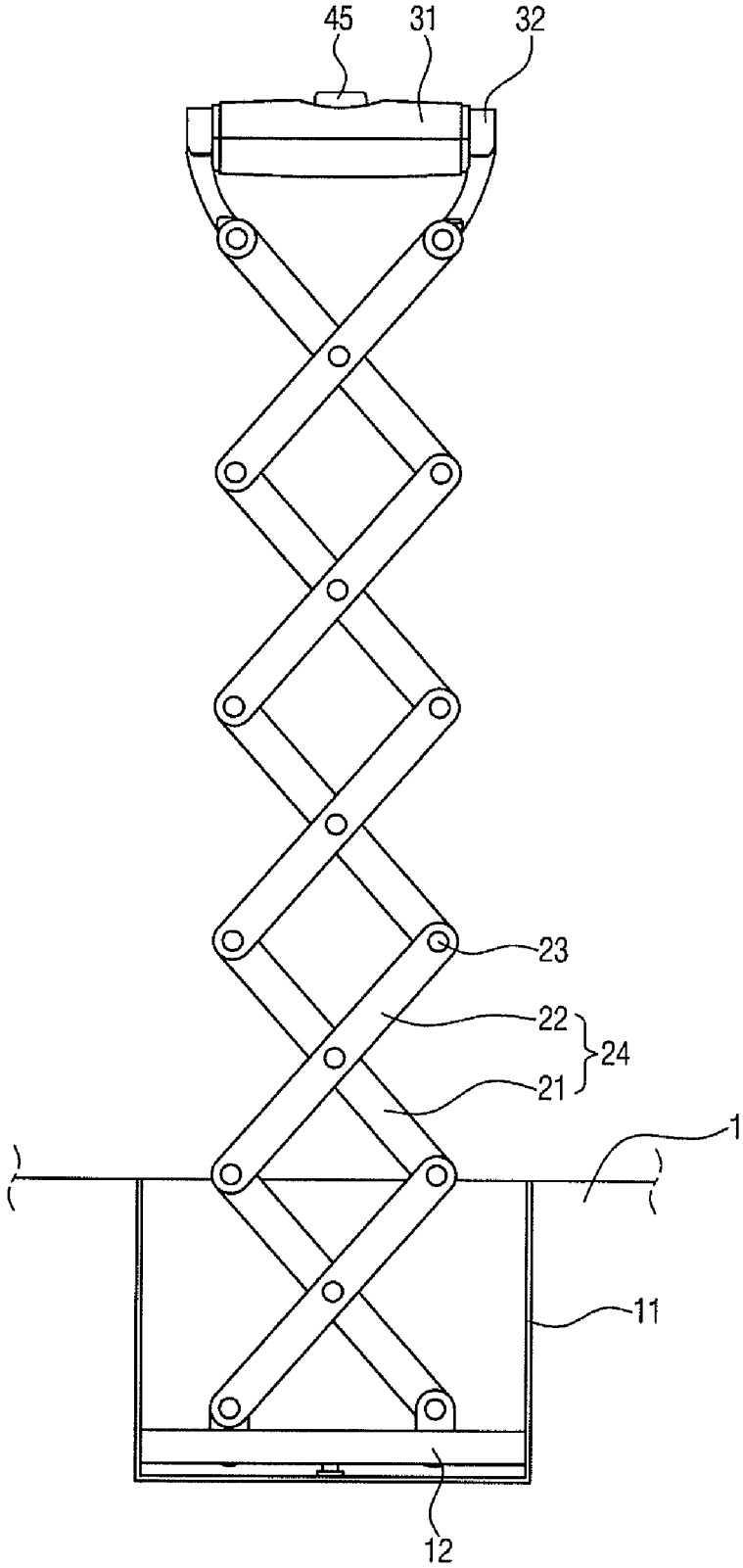
FIG. 5 shows the folding means when unfolded.
Figure 6:
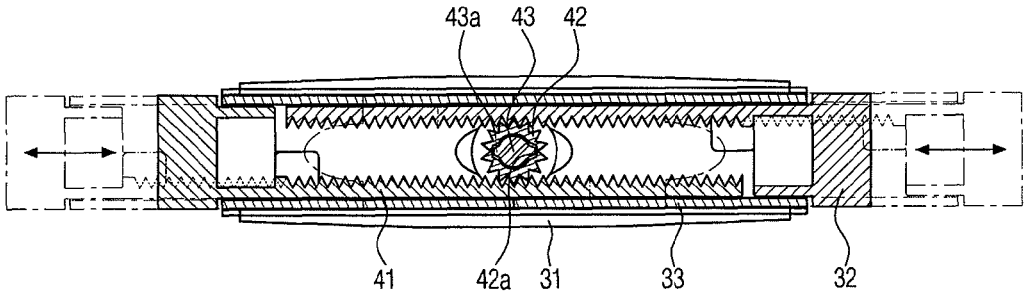
FIG. 6 is a sectional view of fixing bars during sliding.
Figure 7:
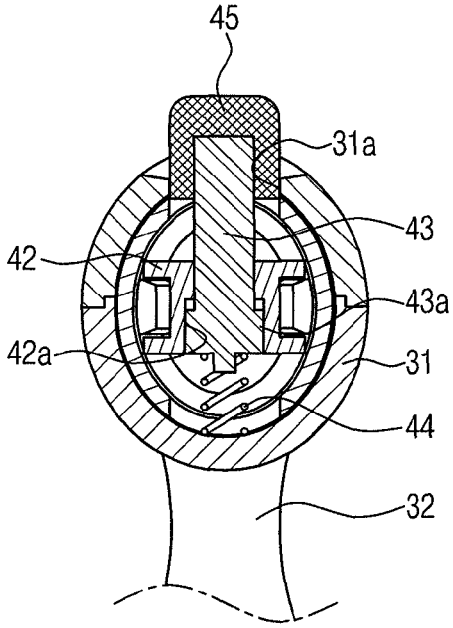
FIG. 7 is a sectional view of a pinion gear when fixed.
Figure 8:
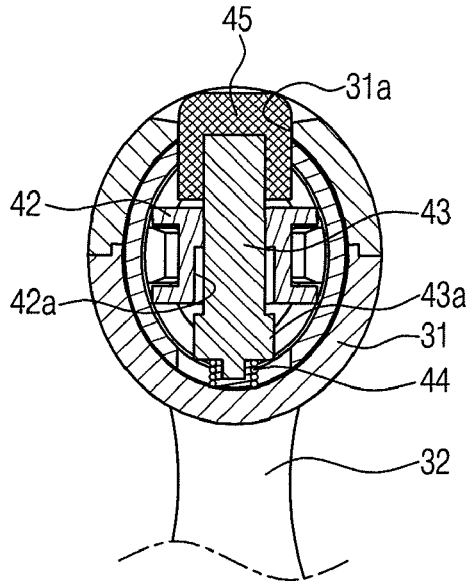
FIG. 8 is a sectional view of the pinion gear when unfixed.
Figure 9:
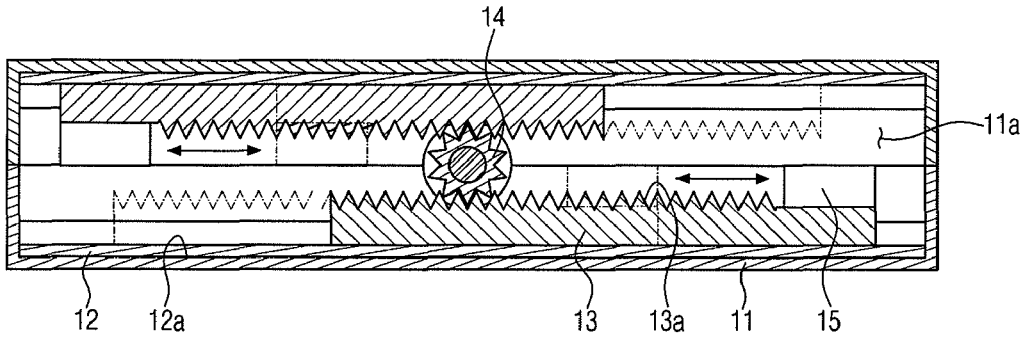
FIG. 9 is a sectional view of sliding plates of a support means during an operation.

FIG. 2 is a perspective view of a foldable cross-patterned pull-handle according to a first exemplary embodiment of the present invention, as well as a bag having the same. FIG. 3 is an exploded perspective view of the foldable pull-handle. FIG. 4 shows a folding means when folded and retracted. FIG. 5 shows the folding means when unfolded. FIG. 6 is a sectional view of fixing bars during sliding. FIG. 7 is a sectional view of a pinion gear when fixed. FIG. 8 is a sectional view of the pinion gear when unfixed. FIG. 9 is a sectional view of sliding plates of a support means during an operation.

As shown, a foldable cross-patterned pull-handle according to a first exemplary embodiment of the present invention, as well as a bag having the same, include a support means 10 mounted on the top of a lateral surface of the bag 1, a folding means 20 having one end fixed to the support means 10, a handle means 30 mounted on the other end of the folding means 20 and grabbed by the user with hand, and a fixing means 40 for temporarily fixing the folding means 20 when it has been extended to the length desired by the user.

The folding means 20 has a number of link assemblies 24 connected to each other in the following manner. The first link assembly 24 has first and second links 21 and 22 and a rotation pin 23 rotatably coupling the center of the first link 21 to that of the second link 22 so that they cross each other. First ends of the first and second links 21 and 22 of the first link assembly 24 are rotatably coupled to second ends of the first and second links 21 and 22 of the second link assembly 24 by rotation pins 23, respectively. When the link assemblies 24 are folded, adjacent link assemblies 24 partially overlap each other.

The support means 10 is either positioned inside the bag 1 or mounted on the outside. The support means 10 is preferably mounted in a detachable manner. Although not shown in the drawings, various attaching/detaching methods can be employed, such as using bolts or fixing clamps.

The support means 10 includes a case 11 provided with a receiving space 11*a*, which has an opening so that the folding means 20 can be received therein, and detachably mounted on the top of the outer peripheral surface of the bag 1, guide rails 12 mounted in the receiving space opposite the opening 11*b* of the case 11, and sliding plates 13 mounted so as to slide along rails 12*a*, which are formed on the guide rails 12, and provided with rack gear portions 13*a* consisting of a number of teeth arranged on a lateral surface in the longitudinal direction, respectively.

Although not shown in the drawings, the first link 21 may have an end coupled to the sliding plates 13 so that it can rotate while sliding, and the second link 22 may have an end hinge-coupled to the bottom of the case 11 so that the folding means 20 is supported while being able to fold/unfold. However, a pair of guide rails 12 is preferably mounted in parallel with each other as shown in the drawings.

As shown, the support means 10 includes a fixing pinion gear 14 rotatably mounted between the sliding plates 13 to engage with respective rack gear portions 13*a*, and gap maintenance plates 15 fixed to the sliding plates 13. The gap maintenance plates 15 extend toward the position of the folding means 20, and the ends of the first and second links 21 and 22 are rotatably hinge-coupled to the gap maintenance plates 15, respectively.

The handle means 30 includes a handle housing 31 grabbed by the user with hand, a sliding hole 31*a* extending through one side of the handle housing 31, and fixing bars 32 mounted on both ends of the sliding hole 31*a* while being able to slide. The other end of the folding means 20 is rotatably connected to the end of the fixing bars 32, which is exposed out of the handle housing 31. More specifically, the ends of the first and second links 21 and 22 are hinge-coupled to the fixing bars 32, respectively. In addition, tubular covers 33 are mounted between the handle housing 31 and the fixing bars 32, respectively. Each cover 33 has a groove 33*a* formed thereon to avoid interference with other components. The fixing means 40 is interposed between the middle portions of the fixing bars 32.

Although not shown in the drawings, the first link 21 may have an end coupled to the fixing bar 32 so that it can rotate while sliding, and the second link 22 may have an end hinge-coupled to the end of handle housing 31 so that the folding means 20 is supported while being able to fold/unfold. However, a pair of fixing bars 32 is preferably mounted as shown in the drawings.

The fixing means 40 includes rack gears 41 having teeth formed in the longitudinal direction, one end of the rack gears 41 being fixed to the fixing bars 32; a pinion gear 42 mounted between the rack gears 41 to simultaneously mesh with the rack gears 41, the pinion gear 42 having at least one fixing groove 42*a* formed on a lateral surface; a pinion shaft 43 rotatably fixing the pinion gear 42, the pinion shaft 43 having a fixing protrusion 43*a* formed on one end and adapted to be temporarily inserted into the fixing groove 42*a*; an elastic member 44 elastically supporting one end of the pinion shaft 43; and a fixing button 45, to which the other end of the pinion shaft 43 is fixed, and the top of which is exposed to the outside via a button hole 31*b* formed on the handle housing 31.

The pull-handle according to the first exemplary embodiment of the present invention, which is constructed as described above, is operated in the following manner: as shown in FIGS. 4 and 5, the link assemblies 24 constituting the folding means 20 are folded on each other or unfolded from each other so that the pull-handle is retracted into or extended from the receiving space 11*a* of the case 11.

When the folding means 20 is folded, the handle means 30 and the fixing means 40 move in such a direction that the fixing bars 32 protrude out of the handle housing 32, as shown in FIGS. 6-8. When the folding means 20 is unfolded and elongated, the handle means 30 and the fixing means 40 move in such a direction that the fixing bars 32 retract into the handle housing 31.

Since respective rack gears 41 mounted on the fixing bars 32 simultaneously mesh with the pinion gear 42, the fixing bars 30 slide while maintaining the same gap with regard to the center of the handle housing 31.

When the elastic member 44 compresses the pinion shaft 43 so that the fixing protrusion 43*a* is inserted into the fixing groove 42*a* of the pinion gear 42, as shown in FIG. 7, the fixed pinion shaft 43 causes the pinion gear 42 to stop rotating. Then, the fixing bars 32 connected to the rack gears 41 also remain still. As a result, the folding means 20 remains in the fixed condition. In other words, if the folding means 20 has been extended by a specific length, the folding means 20 maintains the length.

When the user presses the fixing button 45, the elastic member 44 is deformed, and the pinion shaft 43 is moved, as shown in FIG. 8. Then, the fixing protrusion 43*a* escapes from the fixing groove 42*a* so that the pinion gear 42 can rotate. The fact that the pinion gear 42 can rotate means that the fixing bars 32 connected to the rack gears 41 meshing with the pinion gear 42 can move and that the folding means 20 can be folded or unfolded. In other words, the folding means 20 switches from the fixed condition to a movable condition, in which its length can be varied. If the user stops pressing the fixing button 45, the elastic force from the elastic member 44 returns the pinion shaft 43 to the fixed condition as shown in FIG. 7.

As the folding means 20 is folded or unfolded, as shown in FIG. 9, the sliding plates 13 connected to the gap maintenance plates 15, to which the folding means 20 is hinge-coupled, interwork with each other while meshing with the fixing pinion gear 14. That is, the sliding plates 13 move while maintaining the same gap with regard to the center portion. The gap maintenance plates 15 prevent the folding means 20 from contacting the fixing pinion gear 14.

Figure 10:
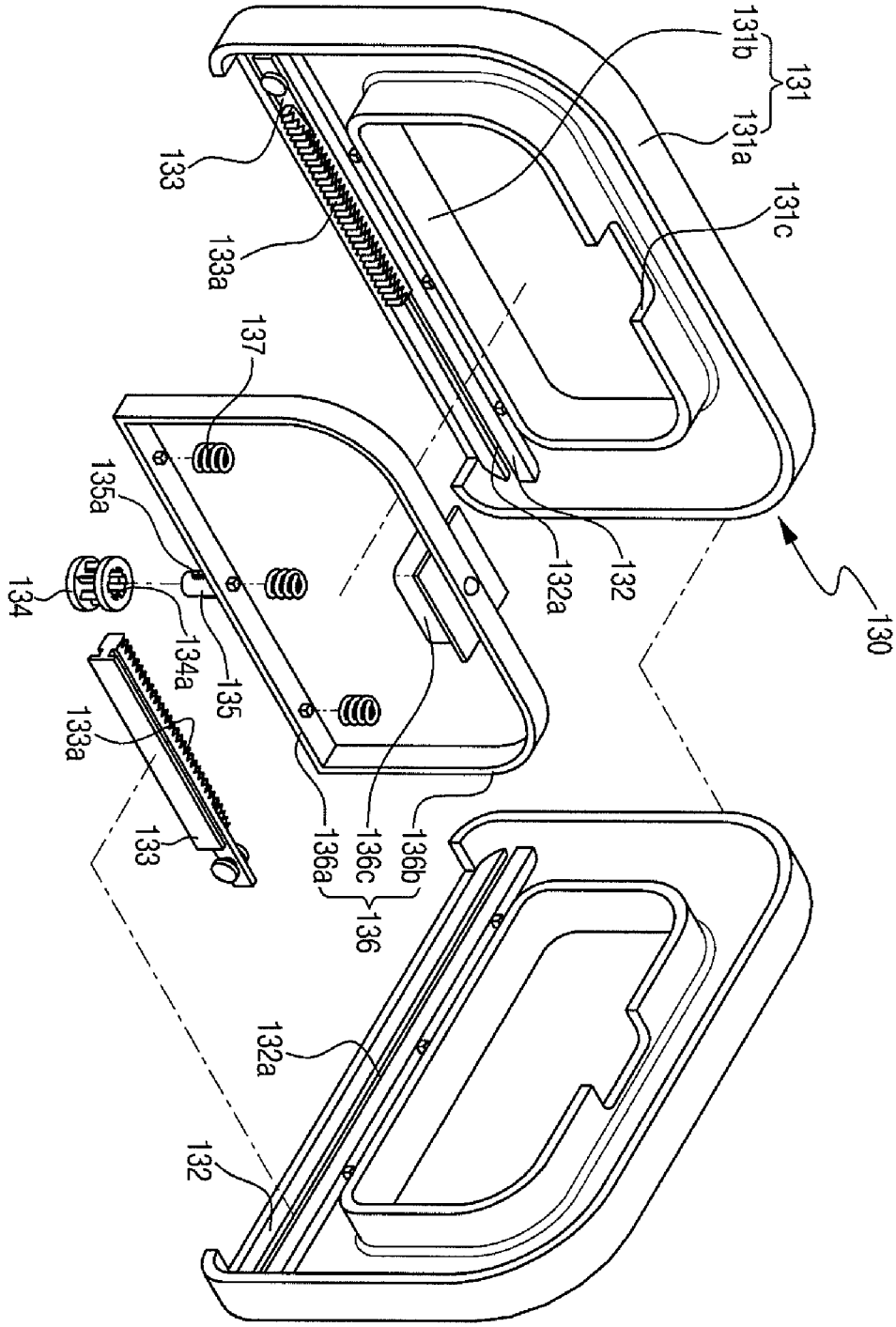
FIG. 10 is a perspective view of a foldable cross-patterned pull-handle according to a second exemplary embodiment of the present invention.
Figure 11:
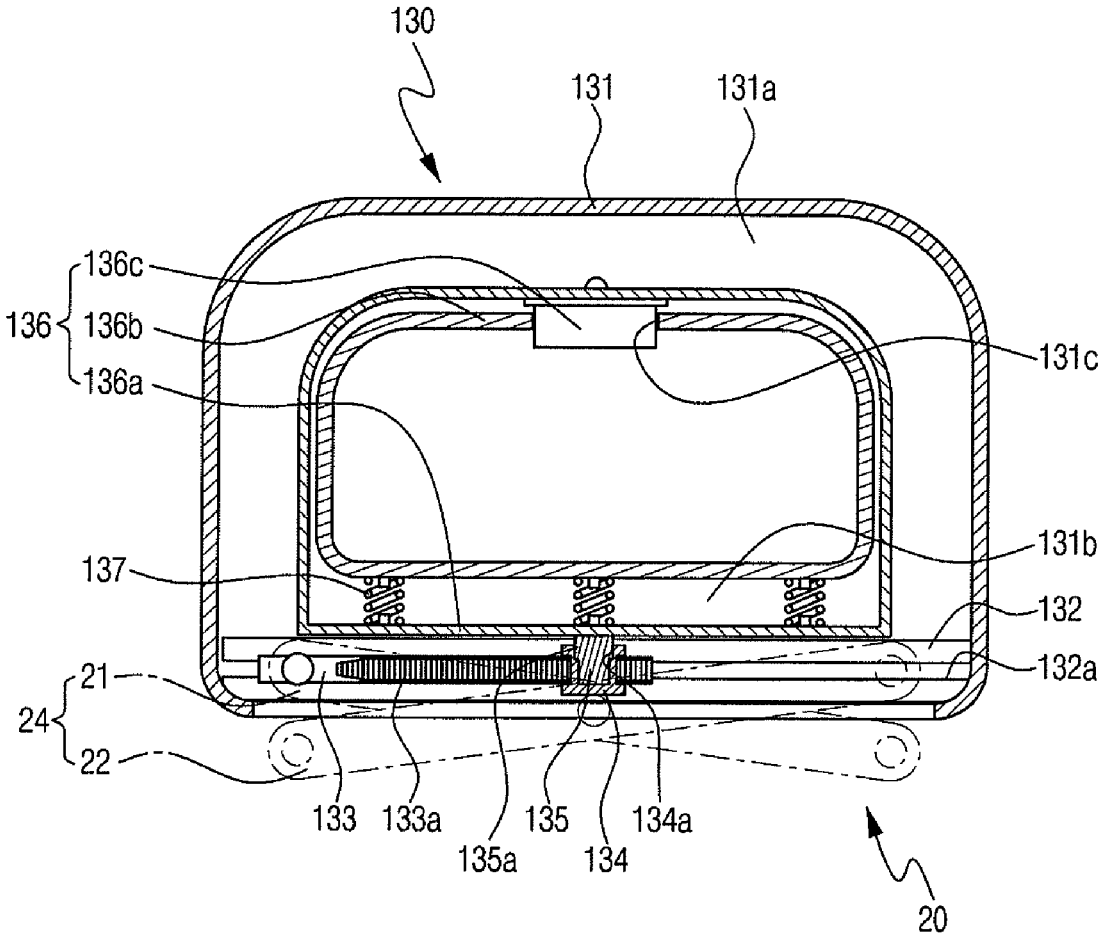
FIG. 11 is a sectional view of a pinion gear shown in FIG. 10 when fixed.
Figure 12:
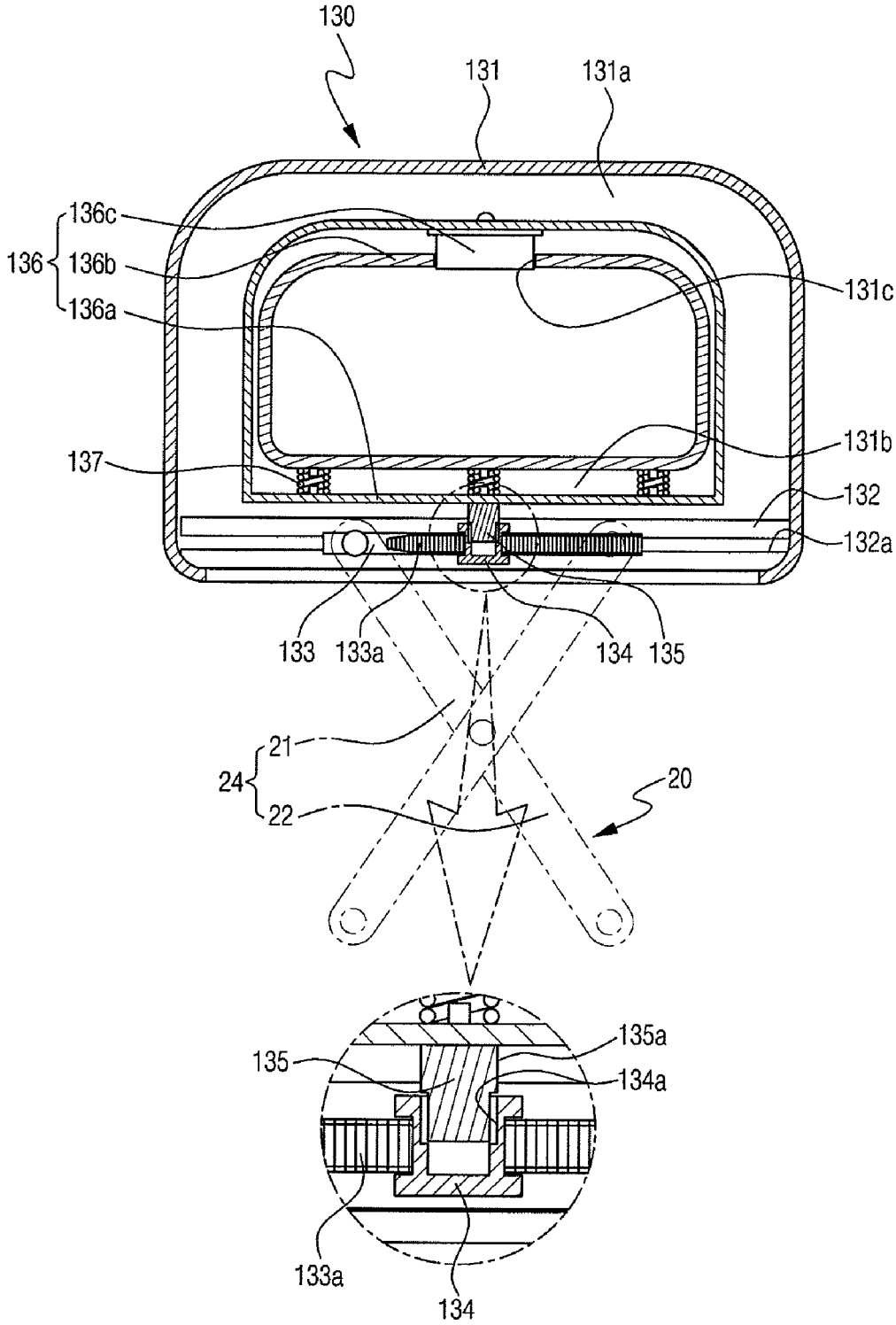
FIG. 12 is a sectional view of the pinion gear shown in FIG. 10 when unfixed.

Referring to FIGS. 10-12, a foldable cross-patterned pull-handle according to a second exemplary embodiment of the present invention, as well as a bag having the same, include a closed-shaped handle housing 131 having a handle portion 131*a* grabbed by the user with hand and a connection portion 131*b*, into which the other end of the folding means 20 is inserted; a pair of guide rails 132 mounted along both inner surfaces of the connection portion 131*b* in parallel with each other; fixing bars 133, to which ends of first and second links 21 and 22 constituting the folding means 20 are rotatably hinge-coupled, respectively, the fixing bars 133 being adapted to slide along rails 132*a* formed on the guide rails 132, respectively, and provided with rack gear portions 133*a* consisting of a number of teeth arranged on opposite surfaces in the longitudinal direction, respectively; a pinion gear 134 mounted between the rack gear portions 133*a* to simultaneously mesh with the rack gear portions 133*a*, the pinion gear 134 having at least one fixing groove 134*a* formed at a predetermined depth on a lateral surface; a pinion shaft 135 rotatably supporting the pinion gear 134 and having a fixing protrusion 135*a* formed on one end to be inserted into the fixing groove 134*a*; a fixing member 136 to which the pinion shaft 135 is fixed; and an elastic member 137 elastically supporting the fixing member 136.

The fixing member 136 includes a support portion 136*a* positioned adjacent to the connection portion 131*b*, the pinion shaft 135 being fixed to the support portion 136*a*, an extension portion 136*b* extending from the support portion 136*a* to the handle portion 131*a*, and a fixing button 136*c* formed on the extension portion 136*b*, the top of the fixing button 136*c* being exposed via a button hole 131*c*, which is formed inside the handle portion 131*a* of the handle housing 131. One side of the elastic member 137 makes contact with the support portion 136*a*, and the other side is supported on the inner surface of the handle housing 131. Particularly, the elastic member 137 supports a surface of the support portion 136*a* opposite the surface on which the pinion shaft 135 is mounted.

The support means 10 and the folding means 20, on which the handle member 130 is mounted, have the same construction and operation as in the first embodiment of the present invention described above.

The foldable cross-patterned pull-handle having the above-mentioned construction is operated in the following manner: when the elastic member 137 compresses the fixing member 136 so that the fixing protrusion 135*a* formed on the pinion shaft 135 is inserted into the fixing groove 134*a* formed on the pinion gear 134, as shown in FIG. 11, the fixed pinion shaft 135 causes the pinion gear 134 to stop rotating. Then, the fixing bars 133 having rack gear portions 133*a* formed thereon also remain still. As a result, the folding means 20 remains in the fixed condition. In other words, if the folding means 20 has been extended by a specific length, the folding means 20 maintains the length.

When the user presses the fixing button 136*c*, as shown in FIG. 12, the elastic member 137 is compressed, and the pinion shaft 135 is moved. Then, the fixing protrusion 135*a* escapes from the fixing groove 134*a* so that the pinion gear 134 can rotate. The fact that the pinion gear 134 can rotate means that the fixing bars 133 provided with the rack gear portions 133*a* meshing with the pinion gear 134 can move and that the folding means 20 can be folded or unfolded. In other words, the folding means 20 switches from the fixed condition to a movable condition, in which its length can be varied. If the user stops pressing the fixing button 136*c*, the elastic force from the elastic member 137 returns the pinion shaft 135 to the fixed condition as shown in FIG. 11.

Figure 13:
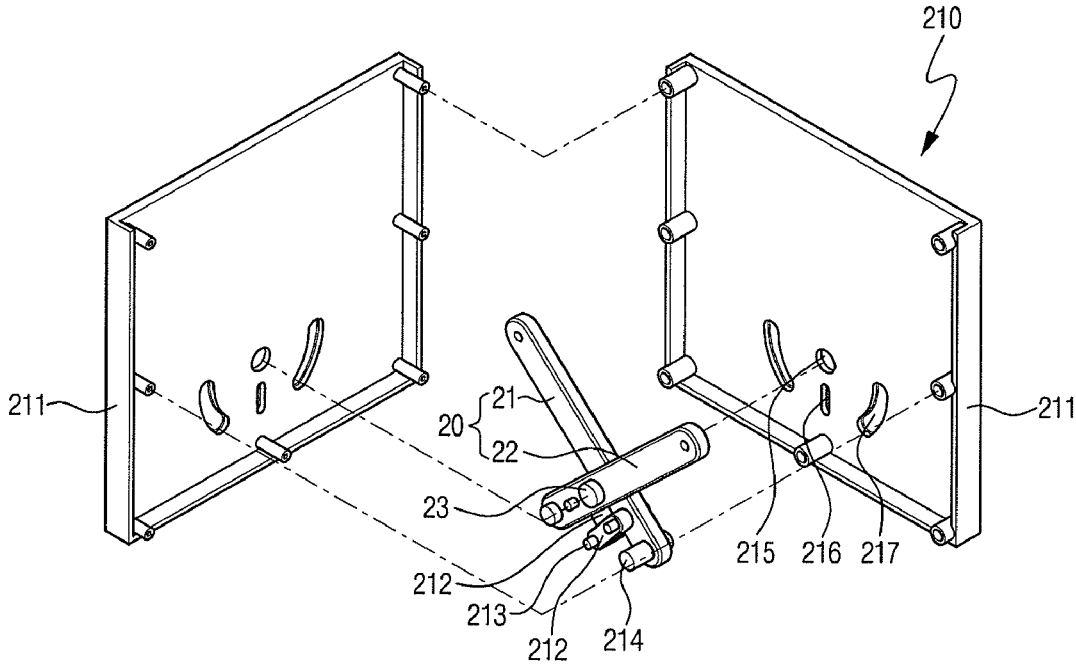
FIG. 13 is a perspective view of a foldable cross-patterned pull-handle according to a third exemplary embodiment of the present invention.
Figure 14:
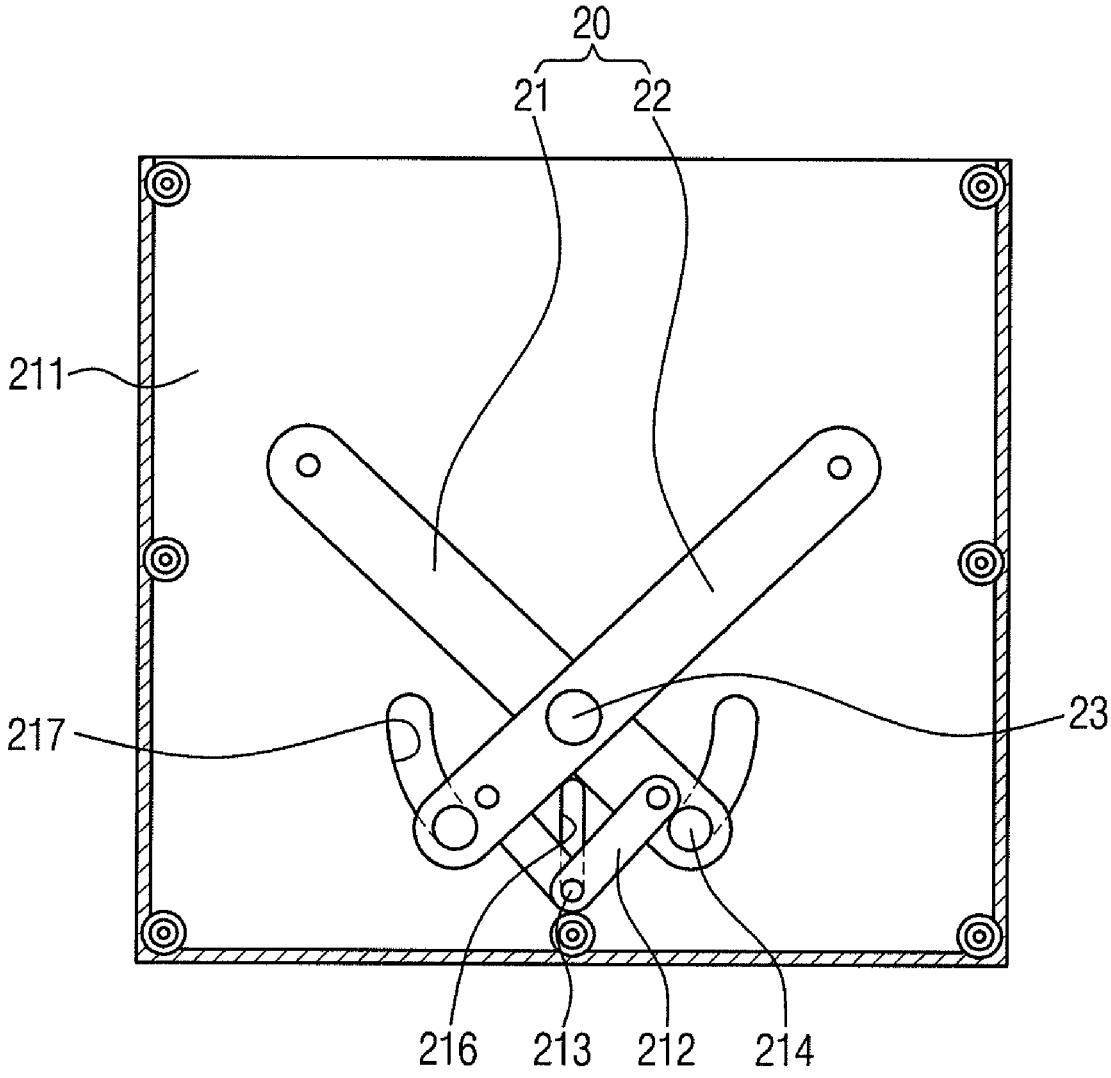
FIG. 14 shows a folding means when folded and retracted.
Figure 15:
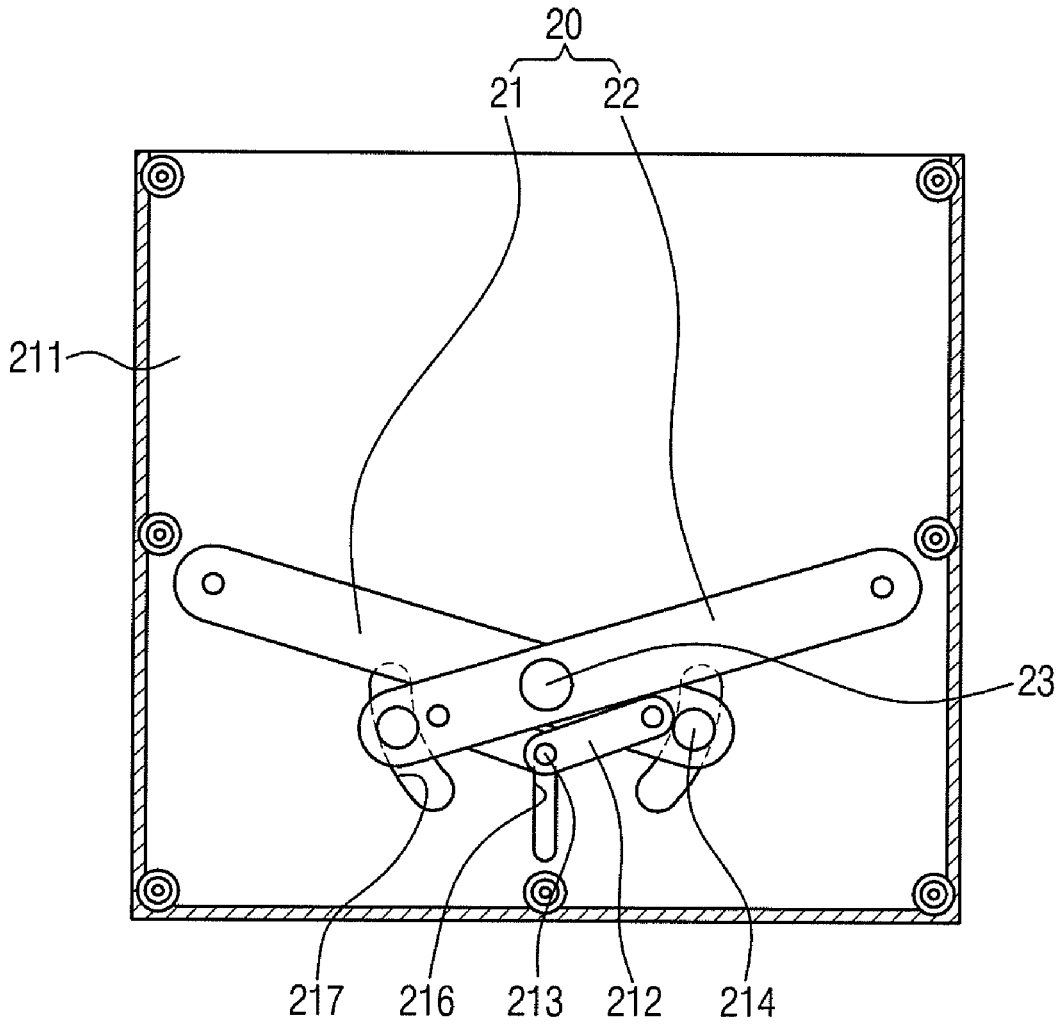
FIG. 15 is a sectional view of a folding means shown in FIG. 13 when unfolded.

Likewise, a foldable cross-patterned pull-handle and a bag having the same according to a third exemplary embodiment of the present invention are constructed as shown in FIGS. 13 to 15.

A support means 210 can be inserted into a bag 1 or mounted on the outside. Preferably the support means 210 is mounted in a detachable manner. Although not shown in the drawings, various attachment/detachment methods can be employed such as fastening bolts or fixing clamps.

In addition, the support means 210 includes a case 211 provided with a receiving space 211*a* with one open side so that the folding means 20 can be received therein, and detachably mounted on the outer peripheral surface of the bag 1; perpendicular links 212 formed at one end portion of the folding means 20, one end portions thereof being rotatably hinge-coupled respectively to one end portions of the first link 21 and the second link 22; a perpendicular pin 213 coupling and rotatably supporting the other end portions of the perpendicular links 212 each other; and sliding pins 214 mounted at one end portions of the first link 21 and the second link 22 formed at one end portion of the folding means 20.

The case 211 has a fixing groove 215 formed on the lateral surface of the interior of the receiving space 211*a*, in which both ends of a rotation pin 23 mounted at the center portion of the first link 21 and the second link 22 are fixed; a perpendicular groove 216 recessed at the bottom portion of the fixing groove 215 at a predetermined depth and extending in parallel to the moving trajectory of the folding means 20 so that the perpendicular pin 213 can be slidably inserted therein; and a sliding groove 217 recessed in pairs left and right at a predetermined depth so that the sliding pin 214 can be slidably inserted therein, and extending so as to form an arc with the center at the fixing groove 215.

The construction and operation of the folding means 20 and the handle means 30, 130, which are mounted on the support means 210, are the same as in the first and the second exemplary embodiments of the present invention.

As shown in FIGS. 14 and 15, the support means 210 as above is constituted such that the perpendicular link 212 is rotated by a folding and extending operation of the folding means 20 so that the perpendicular link 212 slides along the perpendicular groove 216. The movement of the perpendicular link 212 is restricted by the perpendicular groove 216 so as to be parallel with the moving trajectory of the folding means 20 so that the perpendicular link 212 does not deviate from a moving path when the folding means 20 is folded and extended. In other words, since the movement of the perpendicular pin 213 is restricted by the perpendicular groove 216, the perpendicular pin 213 is not rotated in the left or right direction based on the rotation pin 23 fixed on the case while the folding means 20 is extended.

Figure 16:
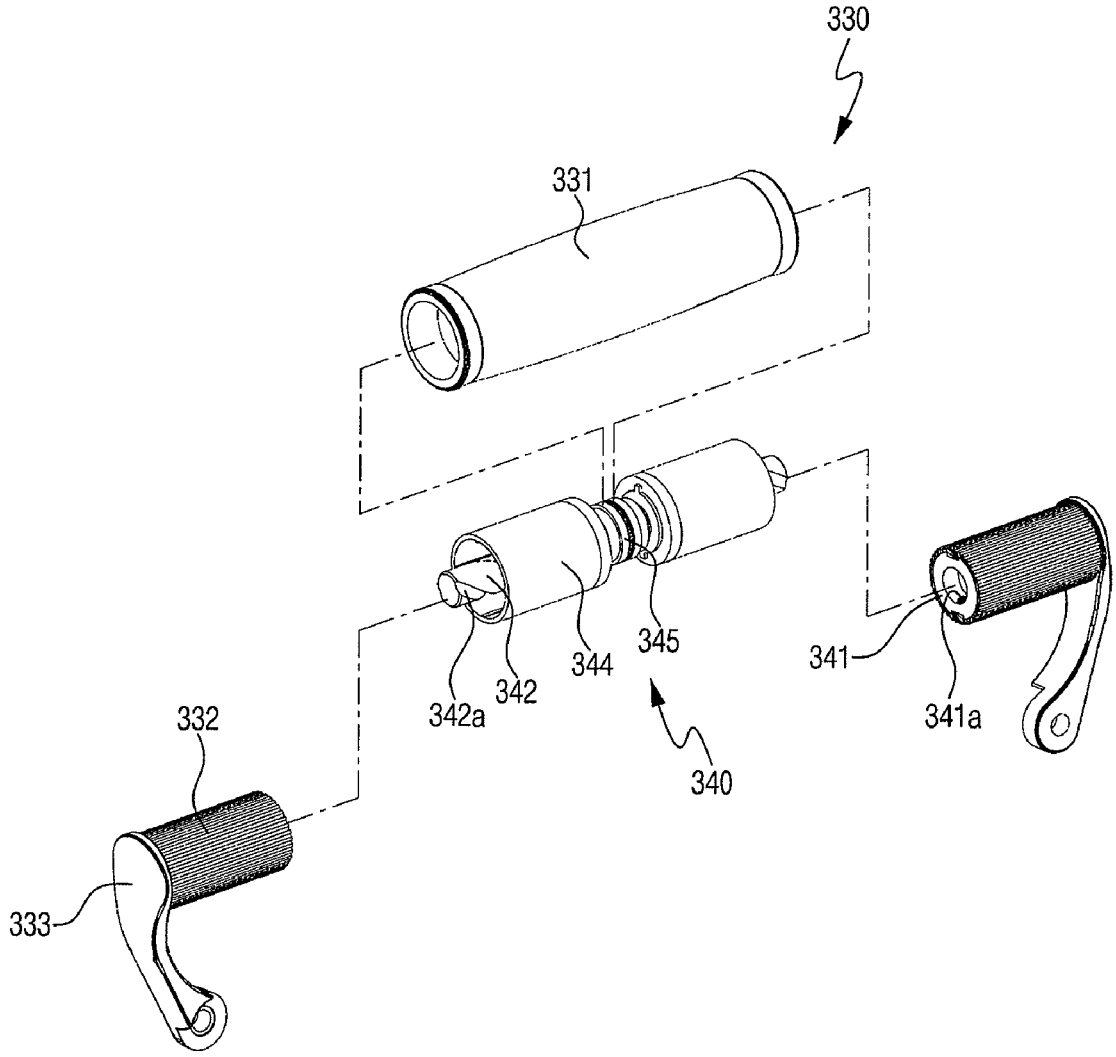
FIG. 16 is a perspective view of a foldable cross-patterned pull-handle according to a fourth exemplary embodiment of the present invention.
Figure 17:
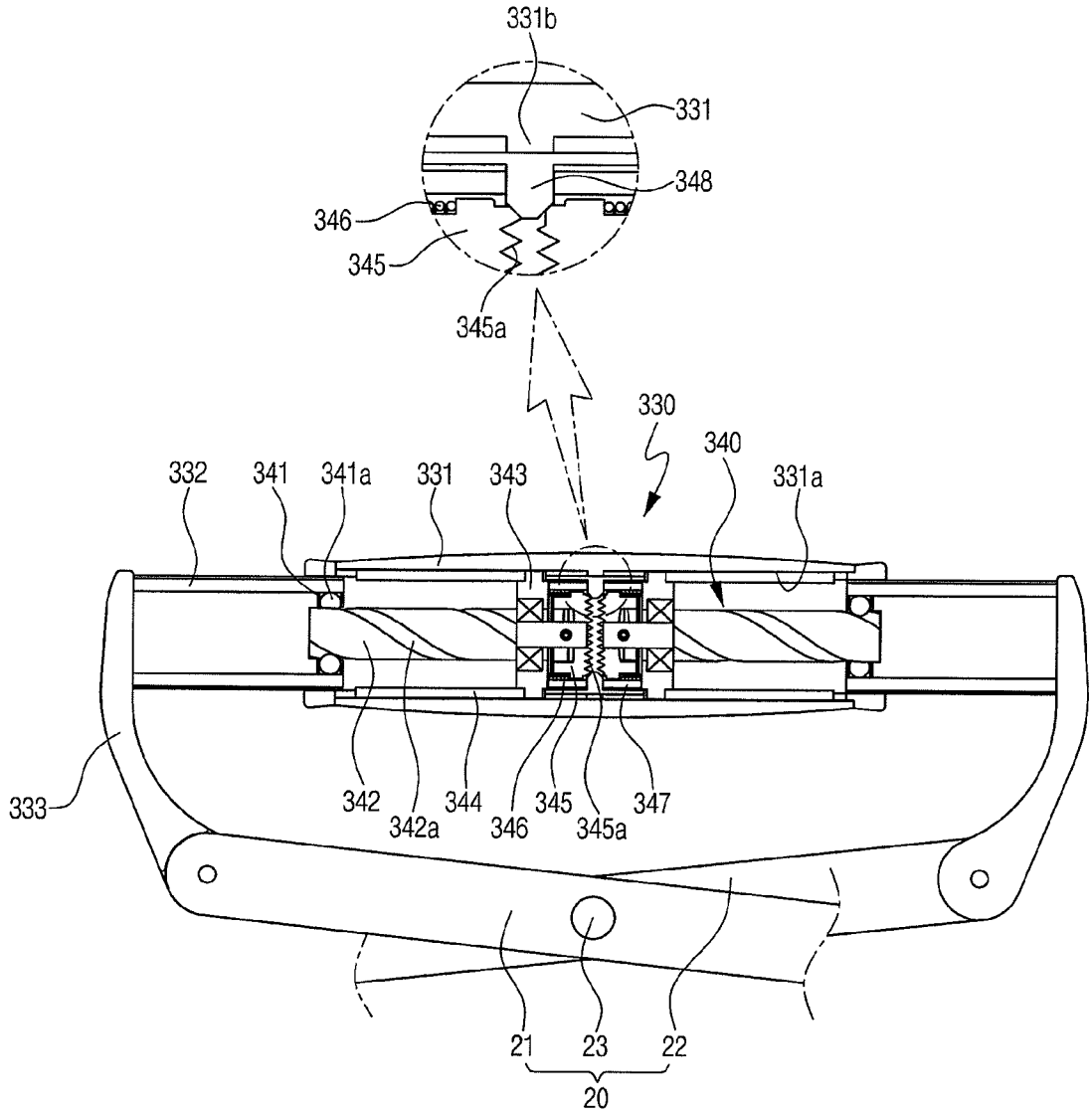
FIG. 17 shows the folding means shown in FIG. 16 when folded.
Figure 18:
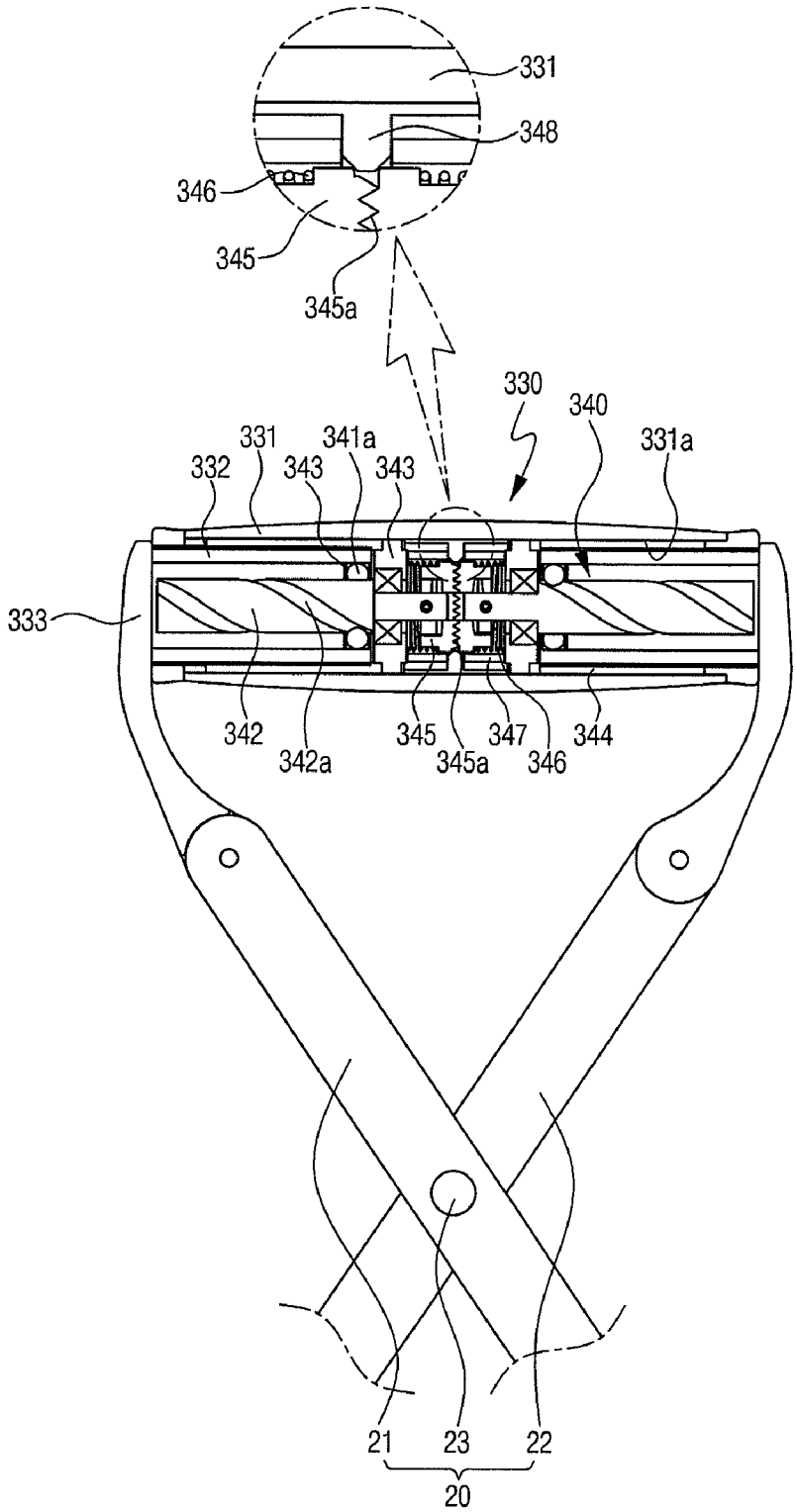
FIG. 18 shows the folding means shown in FIG. 16 when unfolded.

Likewise, a foldable cross-patterned pull-handle according to a fourth exemplary embodiment of the present invention comprises a handle means 330. As shown in FIGS. 16 to 18, the handle means 330 comprises a handle housing 331 grabbed by the user with hand, a sliding hole 331*a* extending through one side of the handle housing 331; an internal housing 332 mounted on both ends of the sliding hole 331*a* so as to slide along the sliding hole; and fixing bars 333 connected to both ends of the outside of the internal housing 332, the other end of the folding means 20 is rotatably connected to the extended end of the fixing bars 333. More specifically, the ends of the first and second links 21 and 22 are hinge-coupled to the fixing bars 333, respectively. In addition, a fixing means 340 is interposed between the middle portions of the fixing bars 333.

The fixing means 340 comprises ball housings 341 mounted on both ends of the internal housing 332; sliding balls 341*a* mounted on the ball housings 341 while being able to roll and protruding toward a center of the internal housing 332; screw shafts 342 mounted on both sides of the sliding hole 331*a* in the identical directions with each other based on the center of the sliding hole 331*a* and having screw grooves 342*a* formed on the outer peripheral surface and wound in the identical directions with each other based on the center of the sliding hole 331*a*; a bearing 343 rotatably supporting the screw shafts 342; a cover 344, into which the internal housing 332 is inserted, and which is rotatably mounted on the inside of the handle housing 331, and to which the bearing 343 is fixed; brakes 345 mounted on the ends of each screw shaft 342 to be able to temporarily contact each other and having a plurality of friction protrusions formed on each contact surface 345*a* where the brakes contact each other; springs 346 mounted between each brake 345 and each bearing 343 to press the brakes 345 in the direction that the brakes 345 contact each other; at least one standoff pins 348 movably supported by pin housings 347 so that protruding ends of the standoff pins are temporarily inserted between the brakes 345 so as to be able to separate the brakes 345 contacting each other, and elastically supported in the opposite direction to the position where the brakes 345 are mounted; and pressing protrusions 331*b* which protrude from a certain portion of the inside of the handle housing 331 by a predetermined height to temporarily press the standoff pins 348 in the direction of the brakes 345.

Preferably, a plurality of the sliding balls 341*a* are arranged at equal intervals with regard to the screw shaft 342, and the number of the screw grooves 342*a* formed on the screw shaft 342 is the same as that of the sliding balls 341*a*. The standoff pins 348 are preferably formed at intervals of 180 degrees so as to be symmetrical to each other, and the pressing protrusions 331*b* are also formed at two positions corresponding to those of the standoff pins 348. Additionally, compression springs are preferably interposed between the standoff pins 348 and the pin housings 347 so as to elastically support the standoff pins 348.

The foldable cross-patterned pull-handle according to a fourth exemplary embodiment of the present invention, which is constructed as described above, is operated in the following manner: as shown in FIGS. 17 and 18, when the folding means 20 is folded, the fixing bars 333 move in such a direction that the fixing bars 333 protrude out of the handle housing 331, and when the folding means 20 is unfolded and elongated, the fixing bars 333 move in such a direction that the fixing bars 333 retract into the handle housing 331.

Since the first link 21 and the second link 22 are folded or unfolded based on the rotation pin 23 mounted at the center portion of the first link 21 and the second link 22, the fixing bars 333 formed on both sides of the handle housing 331 slide while maintaining the same gap with regard to the center of the handle housing 331, and the sliding balls 341*a* connected to the fixing bars 333 move in the left or right direction so that each screw shaft 342 having the screw grooves 342*a* can simultaneously rotate.

When the folding means is to be unfolded, the handle housing 331 is rotated as shown in FIG. 17. Then, the pressing protrusions 331*b* press the standoff pins 348, and the protruding portions of the standoff pins 348 are inserted between the brakes 345 so that the contact surfaces 345*a* are separated and each brake 345 can rotate.

When the brakes 345 are separated to be able to rotate as above, the screw shaft 342 can also rotate. Accordingly, since the sliding balls 341*a* inserted and fixed in the screw grooves 342*a* can roll and move along the screw grooves 342*a* rotating, the folding means 20 can be folded or unfolded. In other words, when the brakes 345 closely contacting each other are separated by the standoff pins 348 so that each brake 345 can rotate and be unfixed, the length of the folding means 20 can be adjusted.

When the folding means 20 is to be fixed while unfolded by a specific length, as shown in FIG. 18, the handle housing 331 is rotated in the opposite direction while the folding means 20 is unfolded by a specific length. Then, the pressing protrusions 331*b* pressing the standoff pins 348 are released, and the elastic force returns the standoff pins 348 to the original state so that the standoff pins escape from the brakes 345. When the standoff pins 348 escape, the contact surfaces 345*a* of each brake 345 contact each other by the elastic force of the spring 346, and the friction protrusions mesh with each other to restrain the rotation so that each screw shaft 342 cannot separately rotate. If the screw shaft 342 cannot separately rotate as above, since the movement of the sliding balls 341*a* meshing with the screw grooves 342*a* is restricted, the fixing bars 333 are fixed, and the folding means 20 can remain fixed. In other words, in order for the fixing bars 333 to extend to the outside, both screw shafts 341 should rotate counterclockwise with regard to the contact surfaces 345*a*, and in order for the fixing bars 333 to retract to the inside, both screw shafts 341 should rotate clockwise with regard to the contact surfaces 345*a*. Accordingly, if the brakes 345 closely contact each other so that each brake cannot separately rotate, the rotational force of both screw shafts 342 is attenuated and the folding means 20 can remain unfolded by a specific length.

As mentioned above, the foldable cross-patterned pull-handle according to the present invention is advantageous in that the folding means, which is adapted to be folded/unfolded, is installed in a reduced installation space, compared with conventional pull-handles. As a result, the bag can contain more items. This improves the performance of the product.

Furthermore, the user can use the fixing means, which is mounted on the handle means, to extend the folding means up to a desired length and temporarily fix it in any extended condition. This improves user convenience.

Although an exemplary embodiment of the present invention has been described for illustrative purposes, those skilled in the art will appreciate that various modifications, additions, and substitutions are possible, without departing from the scope and spirit of the invention as disclosed in the accompanying claims.

What is claimed is:

1. A foldable cross-patterned pull-handle comprising:

a folding means having a plurality of link assemblies pivotally connected to one another so that the folding means can be folded and retracted or unfolded and extended, each link assembly having a first link and a second link that are rotatably coupled to each other by a rotation pin that is located at a center portion of each of the first and second links so that the links cross each other at the center portions, one end of the folding means adapted to be supported on a bag; and a handle means mounted on the other end of the folding means and structured and arranged to be grabbed by a user's hand, wherein the handle means including:

a handle housing that is structured and arranged to be grabbed by the user's hand, a sliding hole extending through a side of the handle housing, and a first fixing bar that is slidably mounted on a first end of the sliding hole and a second fixing bar that is slidably mounted on a second end of the sliding hole opposite the first end, each fixing bar adapted to slide along the sliding hole, the other end of the folding means being rotatably connected to each fixing bar.

2. The foldable cross-patterned pull-handle as claimed in claim 1, wherein the handle means further comprises a fixing means interposed in middle portions of the handle housing, the fixing means structured and arranged to temporarily arrest further movement of the fixing bars so that the folding means can be temporarily locked in place after having been extended to a desired length.

3. The foldable cross-patterned pull-handle as claimed in claim 2, wherein the handle means has a center portion that is disposed equidistant to corresponding distal ends and corresponding proximal ends of each of the fixing bars and wherein the fixing bars and center portion are structured and arranged so that, during translation of the fixing bars, each of the corresponding distal ends and each the corresponding proximal ends remains equidistant with respect to said center portion.

4. The foldable cross-patterned pull-handle as claimed in claim 3, wherein the fixing means comprises:

rack gears having teeth formed in a longitudinal direction, first ends of the rack gears being fixed to the fixing bars, respectively; and a pinion gear mounted between the rack gears so as to contact the rack gears simultaneously, rotation of the pinion gear being controlled.

5. The foldable cross-patterned pull-handle as claimed in claim 4, wherein the fixing means further comprises:

a pinion shaft rotatably fixing the pinion gear, the pinion shaft having a fixing protrusion formed on a first end, the fixing protrusion being temporarily inserted into at least one fixing groove formed on a lateral surface of the pinion gear;

an elastic member supporting the first end of the pinion gear so that the fixing protrusion can remain inserted into the fixing groove; and a fixing button having a top exposed out of the handle housing, a second end of the pinion shaft being fixed to the fixing button so that, by compressing the pinion shaft, the fixing protrusion can temporarily escape from the fixing groove.

6. The foldable cross-patterned pull-handle as claimed in claim 3, wherein the fixing means further comprises:

an internal housing connected to each of the fixing bars and retracting into the sliding hole of the handle housing;

sliding balls mounted on ends of the internal housing to protrude toward a center of the internal housing and to be able to roll;

screw shafts mounted on both sides of the sliding hole of the handle housing based on the center of the sliding hole and having screw grooves formed on the outer peripheral surface to guide the sliding balls in the form of being wound in the identical directions with each other based on the center of the sliding hole;

a bearing rotatably supporting the screw shafts;

a cover rotatably mounted on the inside of the handle housing, the bearing being fixed to the cover;

brakes mounted on the ends of the screw shafts to be able to temporarily contact each other;

springs elastically supporting the brakes in such a manner that the brakes can remain contacted;

standoff pins mounted between the brakes in such a manner that the standoff pins are temporarily inserted between the brakes so that the brakes can be separated by a specific interval and elastically supported in such a direction that the standoff pins escape from the brakes; and pressing protrusions protruding from a certain portion of the inside of the handle housing in such a manner the handle housing rotates to temporarily press the standoff pins between the brakes.

7. The foldable cross-patterned pull-handle as claimed in claim 1, wherein the handle means comprises:

a closed-shaped handle housing having a handle portion and a connection portion, an end of the first link assembly being inserted into the connection portion;

a pair of guide rails mounted along the connection portion of the handle housing;

fixing bars, a second end of the first link assembly being rotatably coupled to each fixing bar, the fixing bars being adapted to slide along the guide rails, respectively, the fixing bars being provided with rack gear portions having teeth arranged on opposite surfaces in a longitudinal direction;

a pinion gear mounted between the rack gear portions of the fixing bars so as to simultaneously mesh with the rack gear portions and rotate, the pinion gear having at least one fixing groove formed on a lateral surface;

a pinion shaft rotatably supporting the pinion gear and having a fixing protrusion formed on a first end, the fixing protrusion being temporarily inserted into the fixing groove;

a fixing member having a support portion, a second end of the pinion shaft being fixed to the support portion, an extension portion extending from the support portion to the handle portion, and a fixing button formed on the extension portion so that the user can press the fixing button to temporarily release the fixing protrusion from the fixing groove, a top of the fixing button being exposed out of the handle housing; and an elastic member supporting the fixing member in a direction opposite to a direction of protrusion of the pinion shaft so that the fixing protrusion can remain inserted into the fixing groove.

8. The foldable cross-patterned pull-handle as claimed in claim 1, wherein the first link assembly of the folding means has a rotation pin mounted to rotatably couple central portions of the first and second links to each other, ends of the first and second links of the second link assembly are rotatably connected to ends of the first and second links of the first link assembly by rotation pins, respectively, and the link assemblies are connected to each other in a zigzag so that, when the link assemblies are retracted into a receiving space, adjacent link assemblies are partially folded on each other.

9. The foldable cross-patterned pull-handle as claimed in claim 8, further comprising a support means fixed to a side of the bag, a receiving space being defined in the support means, a first end of the folding means being supported in the receiving means so that the folding means can be retracted into or extended out of the receiving space;

wherein the support means is detachably mounted on a side of an outer peripheral surface of the bag.

10. The foldable cross-patterned pull-handle as claimed in claim 9, wherein said support means comprises:

a case provided with the receiving space with one open side for receiving the folding means therein, and detachably mounted on the outer peripheral surface of the bag, wherein a rotation pin rotatably supporting the center portion of each of the links formed at one end portion of the folding means is fixed in the interior of the receiving space;

perpendicular links, one end portions thereof being rotatably coupled to one end portion of each of the links formed at one end portion of the folding means; and a perpendicular pin rotatably supporting the other end portion of each of the perpendicular links, and sliding along a perpendicular groove extending so as to be parallel with a moving trajectory of the folding means in the lateral surface of the interior of the case;

wherein said perpendicular means further comprises a sliding pin sliding along a sliding groove recessed in pairs left and right so as to form an arc with a center at the rotation pin fixed on the case, and mounted at one end portion of each of the links formed at one end portion of the folding means.

11. The foldable cross-patterned pull-handle as claimed in claim 1, further comprising a support means fixed to a side of the bag, a receiving space being defined in the support means, a first end of the folding means being supported in the receiving means so that the folding means can be retracted into or extended out of the receiving space.

12. The foldable cross-patterned pull-handle as claimed in claim 11, wherein the support means is detachably mounted on a side of an outer peripheral surface of the bag.

13. The foldable cross-patterned pull-handle as claimed in claim 12, wherein the support means comprises:

a case detachably mounted on the outer peripheral surface of the bag, the receiving space being defined in the case and having an opening so that the folding means can be retracted into the receiving space;

at least one guide rail mounted on a bottom surface of the receiving space opposite the opening of the case; and at least one sliding plate adapted to slide along the guide rail, the first end of the folding means being rotatably coupled to the sliding plate.

14. The foldable cross-patterned pull-handle as claimed in claim 13, wherein the support means has a pair of guide rails mounted on the bottom surface of the case, and respective sliding plates are mounted on the guide rails.

15. The foldable cross-patterned pull-handle as claimed in claim 14, wherein the sliding plates have rack gear portions having teeth arranged in a longitudinal direction on opposite surfaces, respectively, and the support means comprises a fixing pinion gear mounted on the bottom surface of the case and positioned between the rack gear portions of the sliding plates so that the fixing pinion gear can rotate while simultaneously meshing with the rack gear portions.

16. The foldable cross-patterned pull-handle as claimed in claim 15, wherein gap maintenance plates are mounted on the sliding plates while extending toward the folding means to prevent the pinion gear and the folding means from contacting each other, respectively, and the first end of the folding means is rotatably mounted on an end of each gap maintenance plate.

17. The foldable cross-patterned pull-handle as claimed in claim 12, wherein said support means comprises:

a case provided with the receiving space with one open side for receiving the folding means therein, and detachably mounted on the outer peripheral surface of the bag, wherein a rotation pin rotatably supporting the center portion of each of the links formed at one end portion of the folding means is fixed in the interior of the receiving space;

perpendicular links, one end portions thereof being rotatably coupled to one end portion of each of the links formed at one end portion of the folding means; and a perpendicular pin rotatably supporting the other end portion of each of the perpendicular links, and sliding along a perpendicular groove extending so as to be parallel with a moving trajectory of the folding means in the lateral surface of the interior of the case.

18. The foldable cross-patterned pull-handle as claimed in claim 17, wherein said perpendicular means further comprises a sliding pin sliding along a sliding groove recessed in pairs left and right so as to form an arc with a center at the rotation pin fixed on the case, and mounted at one end portion of each of the links formed at one end portion of the folding means.

19. The foldable cross-patterned pull-handle as claimed in claim 12, wherein the support means comprises:

a case detachably mounted on the outer peripheral surface of the bag, the receiving space being defined in the case and having an opening so that the folding means can be retracted into the receiving space;

at least one guide rail mounted on a bottom surface of the receiving space opposite the opening of the case; and at least one sliding plate adapted to slide along the guide rail, the first end of the folding means being rotatably coupled to the sliding plate;

wherein the support means has a pair of guide rails mounted on the bottom surface of the case, and respective sliding plates are mounted on the guide rails;

wherein the sliding plates have rack gear portions having teeth arranged in a longitudinal direction on opposite surfaces, respectively, and the support means comprises a fixing pinion gear mounted on the bottom surface of the case and positioned between the rack gear portions of the sliding plates so that the fixing pinion gear can rotate while simultaneously meshing with the rack gear portions;

wherein gap maintenance plates are mounted on the sliding plates while extending toward the folding means to prevent the pinion gear and the folding means from contacting each other, respectively, and the first end of the folding means is rotatably mounted on an end of each gap maintenance plate.

20. A bag having a foldable cross-patterned pull-handle attached to the bag, the bag comprising:

a support means formed on a portion of the bag, a receiving space being defined in the support means;

a folding means having a first link assembly and a second link assembly pivotally connected to an end of the first link assembly and that is structured and arranged to be folded and retracted into the receiving space or unfolded and extended out of the receiving space, each of the first link assembly and the second link assembly having a first link and a second link that are rotatably coupled to each other by a rotation pin that is located at a center portion of each of the first and second links, a first end of the folding means being supported inside the support means; and a handle means mounted on a second end of the folding means and structured and arranged to be grabbed by a user's hand, wherein the handle means including:

a handle housing that is structured and arranged to be grabbed by the user's hand, a sliding hole extending through a side of the handle housing, and a first fixing bar that is slidably mounted on a first end of the sliding hole and a second fixing bar that is slidably mounted on a second end of the sliding hole opposite the first end, each fixing bar adapted to slide along the sliding hole, the second end of the folding means being rotatably connected to each fixing bar.

* * * * *